US007431258B2

(12) United States Patent
Lamotta

(10) Patent No.: US 7,431,258 B2
(45) Date of Patent: Oct. 7, 2008

(54) TACK FOR HANGING AN ARTICLE FROM A WALL

(76) Inventor: Alan Lamotta, 357 Cortlandt St., Belleville, NJ (US) 07109

( * ) Notice: Subject to any disclaimer, the term of this patent is extended or adjusted under 35 U.S.C. 154(b) by 0 days.

(21) Appl. No.: 11/360,108

(22) Filed: Feb. 22, 2006

(65) Prior Publication Data

US 2007/0194202 A1 Aug. 23, 2007

(51) Int. Cl.
*A47F 7/14* (2006.01)

(52) U.S. Cl. ..... 248/475.1; 248/217.3; 248/301

(58) Field of Classification Search ..... 248/489, 248/493, 494, 497, 498, 475.1, 547, 217.3, 248/301, 546, 684, 300; 411/473, 474, 477, 411/478, 499

See application file for complete search history.

(56) References Cited

U.S. PATENT DOCUMENTS 1,223,802 A * 4/1917 Kuhn ..... 248/498
2,454,813 A * 11/1948 Larson ..... 248/493
2,674,149 A * 4/1954 Benson ..... 411/473
4,333,625 A * 6/1982 Haug ..... 248/216.1
5,048,788 A * 9/1991 Lorincz ..... 248/477
5,236,168 A * 8/1993 Roy ..... 248/546
5,267,718 A * 12/1993 Sheehan ..... 248/475.1
6,196,506 B1 * 3/2001 Wakai ..... 248/216.1

* cited by examiner

*Primary Examiner*—Korie Chan
(74) *Attorney, Agent, or Firm*—Charles E. Baxley

(57) ABSTRACT

A tack for hanging an article from a wall. The tack includes a plate and a pin. The plate abuts the wall. The pin has a picture-engaging portion extending diagonally upwardly and forwardly from the plate to engage the picture and a wall-engaging portion extending diagonally downwardly and rearwardly from the plate to penetrate the wall when the plate is pressed by a thumb of a user. In one embodiment, the wall-engaging portion of the pin is singular and collinear with the picture-engaging portion of the pin. In another embodiment, the wall-engaging portion of the pin is doubled to form a pair of wall-engaging portions that straddle, and are parallel to, the picture-engaging portion of the pin. In another embodiment, the plate has a lower portion with a pair of axial legs terminating in free ends that are beveled for safety and an upper portion with a pair of axial legs having a pair of spikes, respectively, extending diagonally downwardly and rearwardly therefrom to penetrate the wall when the plate is pressed by the thumb of the user, and which are one piece with, and stamped and bent from, the pair of axial legs of the upper portion of the plate, respectively, and which are parallel to, spaced from, and straddle, the wall-engaging portion of the pin.

16 Claims, 4 Drawing Sheets

TACK FOR HANGING AN ARTICLE FROM A WALL

BACKGROUND OF THE INVENTION

A. Field of the Invention

The present invention relates to a tack, and more particularly, the present invention relates to a tack for hanging an article from a wall.

B. Description of the Prior Art

In the normal practice of hanging articles, such as pictures, from a wall, a cord or wire that is affixed to the picture or to the frame in which it is mounted is supported from a hook anchored to the wall.

Numerous innovations for hooks for hanging articles from a wall have been provided in the prior art that will be discussed below. Even though these innovations may be suitable for the specific individual purposes to which they address, they each differ in structure and/or operation and/or purpose from the present invention.

(1) U.S. Pat. No. 674,438 to Edmundson.

U.S. Pat. No. 674,438 issued to Edmundson on May 21, 1901 teaches a picture hook including a plate with a lower hooked end and a forwardly projecting extension at its upper end bent back upon itself to form a guiding lip. The extension and plate are provided with aligning perforations for the insertion of pins or nails.

(2) U.S. Pat. No. 992,203 to Johnson.

U.S. Pat. No. 992,203 issued to Johnson on May 16, 1911 teaches a picture hanger including a pair of inner and outer parallel plates secured together in contact with each other. Each plate has a perforation therein. The perforation in the outer plate is in vertical alignment with, and slightly above, the perforations in the inner plate.

(3) U.S. Pat. No. 1,560,029 to Erickson.

U.S. Pat. No. 1,560,029 issued to Erickson on Nov. 3, 1925 teaches a hanger including a body member having an annular flange, a yieldable disk seated within the annular flange and adhesively secured to the back of the body member, an adhesive surface formed on the exterior face of the disk, and a supporting hook stamped from the body member and extending from the front of the body member.

(4) U.S. Pat. No. 2,317,368 to Frey.

U.S. Pat. No. 2,317,368 issued to Frey on Jul. 9, 1940 teaches a hook device including a web and provided at one end forming the top of the device with a nail-receiving apparatus whereby the device is adapted to be secured to a wall. The web at the other end is bent outwardly and upwardly to form a hook open at the top. The hook is partially enclosed at the sides by integral portions extending upwardly from the bottom thereof and provided with vertically extending tapered slots adapted to receive, and frictionally hold, a picture wire against slippage when wedged therein.

(5) U.S. Pat. No. 2,330,373 to Moore.

U.S. Pat. No. 2,330,373 issued to Moore on Jan. 27, 1942 teaches a picture hook including a strip of stiff material having a normally vertical mid-portion and a lower portion bent upward tp make an acute angle with the mid-portion, an inturned flange at the extremity of the lower portion of the strip, and a piece of relatively soft frictional material fitted against the inner face of the lower portion between the bend and the inturned flange.

(6) U.S. Pat. No. 3,298,651 to Passer.

U.S. Pat. No. 3,298,651 issued to Passer on Mar. 7, 1966 teaches a wall hanger for suspending an article from a wall. The hanger is formed from a single piece of sheet metal and includes a flat plate and a pair of pointed slender tines integral with the plate. Each tine has a base joined to the plate. The bases of the tines are laterally spaced-apart on the plate and located intermediate the ends of the plate. Each tine projects rearwardly from the plate with its base generally perpendicular to the plate and the tine has an uninterrupted sweeping arc of large radius. The tip of each tine lies along a chord running from the tip to the base perpendicular to the plate. The tip of each tine forms an interior angle of slightly less than 90° to a plane perpendicular to the chord. The tines are laterally outwardly concave and downwardly concave whereby the tines are compoundly curved. An upwardly facing hook is integral with the plate and projects forwardly therefrom, whereby when the hanger is fixed to a wall by the insertion of the tines into the interior of a wall as by thumb pressure, the tines follow a curved path and assume a more arcuate curled configuration, thereby resisting removal from the wall.

(7) U.S. Pat. No. 3,912,211 to Topf.

U.S. Pat. No. 3,912,211 issued to Topfon Oct. 14, 1975 teaches a picture hook including a generally flat body with a depending leg having a hooked lower end portion from which a picture may be hung when the hook is mounted on a wall. An aperture in the central portion of the body receives a fastener for securing the picture hook to the wall and upper and lower lips formed in the body around the aperture serve to guide the fastener into the wall at a preselected angle. The upper lip projects rearwardly and downwardly from the body to define the upper edge of the aperture and the lower lip extends upwardly and forwardly from the body to define the lower edge of the aperture. A crescent-shaped indentation in the front side of the body above the aperture receives the upper portion of the head of the fastener so the latter is disposed out-of-the-way to avoid interfering with the hanging of the picture.

(8) U.S. Pat. No. 4,017,048 to Einhorn.

U.S. Pat. No. 4,017,048 issued to Einhorn on Apr. 12, 1977 teaches a base member of a push pin formed by casting or molding, and a pin inserted pointed end first into a hole in the base member and forced through the base member until the end opposite thereof lies below the surface of the base member. The material of the base member is then flowed over the end of the pin by mechanical or heat techniques to form a substantially complete layer over the end of the pin within the base member. The pins preferably extend at an acute angle to a flat surface of the base member. The push pin may have pins extending from opposite surfaces thereof, a loop shaped projection adapted to be affixed to a wire, or a hinge separating the base member into a hook portion and a portion carrying one or more pins. The push pin may have a contoured base member to facilitate the affixing of a picture wire to a hook formed on the base member. In another embodiment, the push pin has a projection on the side thereof through which the pin extends. The projection has a rounded contour adjacent the pin, a radially outer surface, and an intermediate axially extending section between the rounded surface and the radially outer portion. The push pin may be formed with a pivoted lever to serve as a wire clamp. For picture hanging purposes, the push pin may include a pair of pins extending from opposite sides of an elongated member and through projections. The elongated member has a saw tooth edge. The planes of the saw tooth edge and the side of the elongated member adjacent thereto extend at an angle corresponding to portions of a nail extending at an angle in the wall in order to facilitate the hanging of a picture on the wall.

(9) U.S. Pat. No. 4,619,430 to Hogg.

U.S. Pat. No. 4,619,430 issued to Hogg on Oct. 28, 1986 teaches a device, such as a picture frame hanger, for supporting a flexible, elongated article, such as a picture frame having a convex lip fastened to a backplate so that an arched groove and a circular contact area are formed. The flexible, elongated article hangs on the curved top surface of the contact area and freely from either side of the arched groove and presses against the backplate when seated within the groove. The device can be anchored to a wall or other suitable surface in a manner preventing the twisting or movement thereof under load or contact.

(10) U.S. Pat. No. 5,018,697 to Treanor et al.

U.S. Pat. No. 5,018,697 issued to Treanor et al. on May 28, 1991 teaches a hanger for suspending objects, such as framed pictures and knickknacks, for use on building interior wall surfaces of semi-permeable composition, such as drywall. The hanger attaches to drywall by a straight pin instead of nails or screws, thereby dramatically reducing the hole size remaining when the hanger is removed. The hanger includes a body connected to a hanger inserter by a hinge. A pin is inserted in an aperture formed through the body. The head of the pin is positioned in a channel created by a recessed U-shaped arcing groove in the inserter. The groove has a concave curvature matching the convex curvature of the pinhead. By applying force to the inserter push surface, the inserter rotates downward about the hinge and the pin penetrates the drywall. The hanger is used for suspending objects on a wall surface. The hanger is removed by pulling upward and away from the wall by gripping the body side surfaces.

(11) U.S. Pat. No. 5,267,718 to Sheehan.

U.S. Pat. No. 5,267,718 issued to Sheehan on Dec. 7, 1993 teaches a single piece hanger structure having rearwardly extending prongs for mounting the hanger to a wall and a forwardly directed hump situated between upper and lower sets of the prongs to define a prying gap that may be used to pry the hanger from the wall without substantially damaging the wall.

(12) U.S. Pat. No. Des. 422,892 to Donovan.

U.S. Pat. No. Des. 422,892 issued to Donovan on Apr. 18, 2000 teaches the ornamental design for a wall hanger.

(13) U.S. Pat. No. 6,629,680 to Week et al.

U.S. Pat. No. 6,629,680 issued to Weck et al. on Oct. 7, 2003 teaches a picture hanger having a metal base from which is stamped a tongue for receiving a wire of a picture frame hung on a wall. The tongue has a convex shape with respect to a front face 14 of the base and a ledge thereof on which the wire rests bears against a protrusion extending from the base front face. The tongue has bends with progressively increasing angles as it extends away from the base.

It is apparent that numerous innovations for hooks for hanging articles from a wall have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

Thus, an object of the present invention is to provide a tack for hanging an article from a wall that avoids the disadvantages of the prior art.

Briefly stated, another object of the present invention is to provide a tack for hanging an article from a wall. The tack includes a plate and a pin. The plate abuts the wall. The pin has a picture-engaging portion extending diagonally upwardly and forwardly from the plate to engage the picture and a wall-engaging portion extending diagonally downwardly and rearwardly from the plate to penetrate the wall when the plate is pressed by a thumb of a user. In one embodiment, the wall-engaging portion of the pin is singular and collinear with the picture-engaging portion of the pin. In another embodiment, the wall-engaging portion of the pin is doubled to form a pair of wall-engaging portions that straddle, and are parallel to the picture-engaging portion of the pin. In another embodiment, the plate has a lower portion with a pair of axial legs terminating in free ends that are beveled for safety and an upper portion with a pair of axial legs having a pair of spikes, respectively, extending diagonally downwardly and rearwardly therefrom to penetrate the wall when the plate is pressed by the thumb of the user, and which are one piece with, and stamped and bent from, the pair of axial legs of the upper portion of the plate, respectively, and which are parallel to, spaced from, and straddle, the wall-engaging portion of the pin.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

A. General

Figure 1:
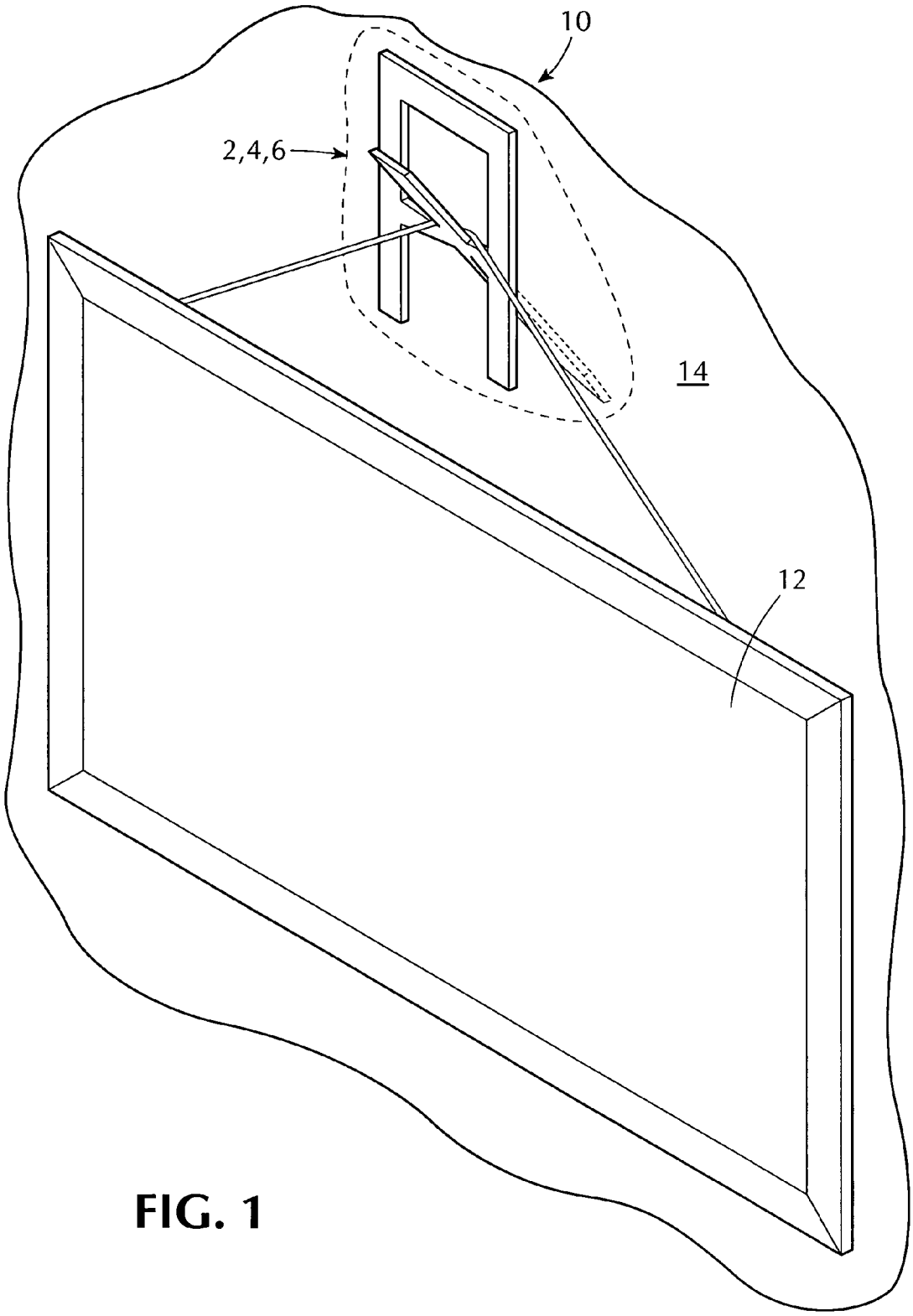
FIG. 1 is an exaggerated diagrammatic perspective view of the tack of the present invention hanging an article form a wall.

10 tack of present invention for hanging article 12 from wall 14

12 article

14 wall

B. First Embodiment

110 tack
116 plate for abutting wall 14 and for providing surface for thumb of user to use to press pin 118 into wall 14
118 pin for engaging picture 12 and for penetrating wall 14 when plate 116 is pressed by thumb of user
120 wall-facing surface of plate 116
122 picture-facing surface of plate 116
124 picture-engaging portion of pin 118
126 wall-engaging portion of pin 118
128 upper portion of plate 116
130 lower portion of plate 116
132 cross member of plate 116
134 pair of axial legs of upper portion 128 of plate 116
136 upper transverse portion of upper portion 128 of plate 116
138 bottom of upper portion 128 of plate 116
140 inner length of each leg of pair of axially legs 134 of upper portion 128 of plate 116
142 length of picture-engaging portion 124 of pin 118
144 pair of axial legs of lower portion 130 of plate 116
146 bottom of lower portion 130 of plate 116
148 inner length of each leg of pair of axially legs 144 of lower portion 130 of plate 116
150 length of wall-engaging portion 126 of pin 118
152 free end of wall-engaging portion 126 of pin 118

C. Second Embodiment

210 tack
218 pin
224 picture-engaging portion of pin 218
226 wall-engaging portion of pin 218
254 pair of wall-engaging portions of pin 218

D. Third Embodiment

310 tack
316 plate
318 pill
326 wall-engaging portion of pin 318
328 upper portion of plate 316
330 lower portion of plate 316
334 pair of axial legs of upper portion 328 of plate 316
344 pair of axial legs of lower portion 330 of plate 316
356 free ends of pair of axial legs 344 of lower portion 330 of plate 316
358 pair of spikes extending diagonally downwardly and rearwardly from pair of axial legs 334 of upper portion 328 of plate 316, respectively, for penetrating wall 14 when plate 316 is pressed by thumb of user E. Detailed Description of the Preferred Embodiment A. General Referring now to the figures, in which like numerals indicate like parts, and particularly to FIG. 1, which is an exaggerated diagrammatic perspective view of the tack of the present invention hanging an article from a wall, the tack of the present invention is shown generally at 10 for hanging an article 12 from a wall 14.

B. First Embodiment

Figure 3:
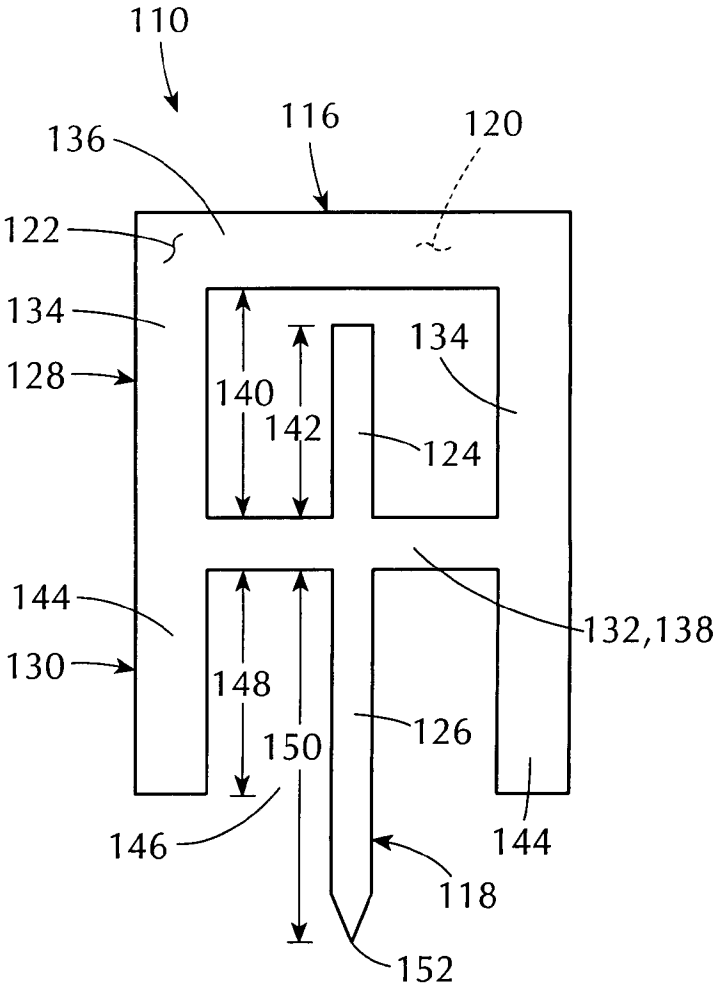
FIG. 3 is a diagrammatic front elevational view taken generally in the direction of ARROW 3 in FIG. 2.
Figure 2:
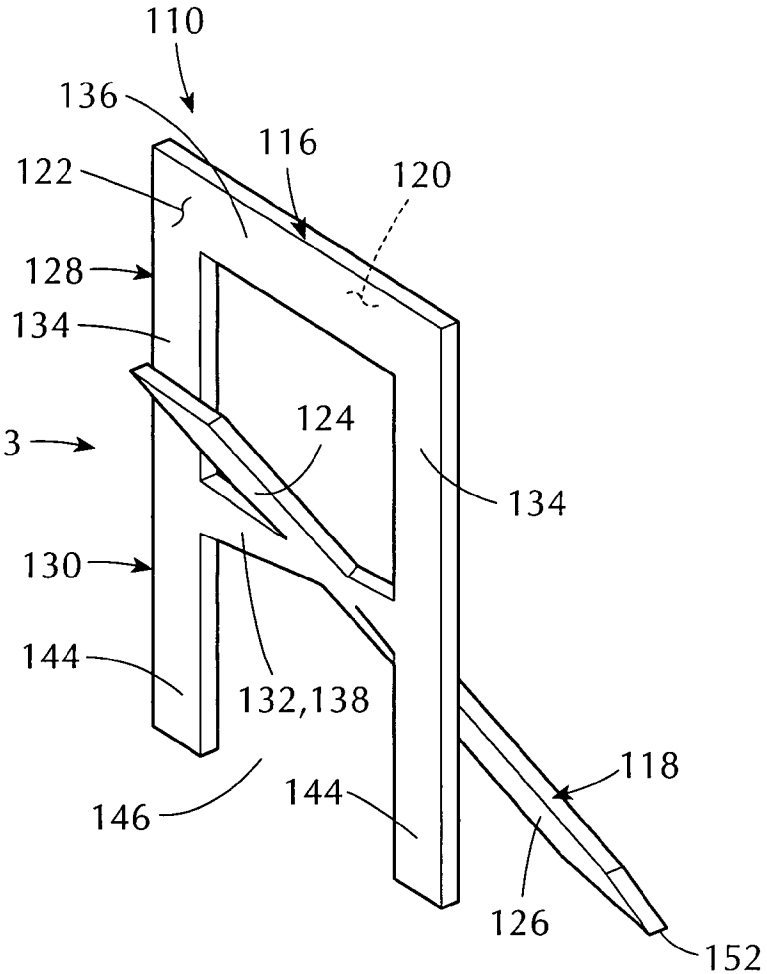
FIG. 2 is an enlarged diagrammatic perspective view of the area generally enclosed by the dotted curve identified by ARROW 2 in FIG. 1 of a first embodiment of the tack of the present invention.

The configuration of a first embodiment of the tack 110 can best be seen in FIGS. 2 and 3, which are, respectively, an enlarged diagrammatic perspective view of the area generally enclosed by the dotted curve identified by ARROW 2 in FIG. 1 of a first embodiment of the tack of the present invention, and, a diagrammatic front elevational view taken generally in the direction of ARROW 3 in FIG. 2, and as such, will be discussed with reference thereto.

The tack 110 comprises a plate 116 and a pin 118. The plate 116 is for abutting the wall 14 and for providing a surface for a thumb of a user to use to press the pin 118 into the wall 14. The pin 118 extends diagonally upwardly and forwardly from the plate 116 for engaging the picture 12 and diagonally downwardly and rearwardly from the plate 116 for penetrating the wall 14 when the plate 116 is pressed by the thumb of the user.

The plate 116 has a wall-facing surface 120 and a picture-facing surface 122. The picture-facing surface 122 of the plate 116 is opposite to the wall-facing surface 120 of the plate 116. The pin 118 has a picture-engaging portion 124 and a wall-engaging portion 126. The picture-engaging portion 124 of the pin 118 extends diagonally upwardly from the picture-facing surface 122 of the plate 116 and the wall-engaging portion 126 of the pin 118 extends diagonally downwardly from the wall-facing surface 120 of the plate 116.

The pin 118 is one piece with the plate 116 and is stamped and bent therefrom.

The wall-engaging portion 126 of the pin 118 is singular and collinear with the picture-engaging portion 124 of the pin 118.

The plate 116 has an upper portion 128 and a lower portion 130. The upper portion 128 of the plate 116 is divided from the lower portion 130 of the plate 116 by a cross member 132 of the plate 116.

The picture-engaging portion 124 of the pin 118 extends diagonally upwardly and forwardly from the cross member 132 of the plate 116 and the wall-engaging portion 126 of the pin 118 extends diagonally downwardly and rearwardly from the cross member 132 of the plate 116.

The upper portion 128 of the plate 116 is preferably inverted U-shaped and is formed by a pair of axial legs 134 and an upper transverse portion 136. The pair of axial legs 134 of the upper portion 128 of the plate 116 are connected to each other by the upper transverse portion 136 of the upper portion 128 of the plate 116 so as to define a bottom 138 of the upper portion 128 of the plate 116 that is closed by the cross member 132 of the plate 116.

Each leg of the pair of axially legs 134 of the upper portion 128 of the plate 116 has an inner length 140 and the picture-engaging portion 124 of the pin 118 has a length 142. The length 142 of the picture-engaging portion 124 of the pin 118 is less than the inner length 140 of each leg of the pair of axial legs 134 of the upper portion 128 of the plate 116 so as to allow the picture-engaging portion 124 of the pin 118 to be bent diagonally upwardly and forwardly out of the upper portion 128 of the plate 116 without interference from the upper transverse portion 136 of the upper portion 128 of the plate 116. The upper transverse portion 136 of the upper portion 128 of the plate 116, together with the cross member 132 of the plate 116, provide a rigid and continuous surface of the upper portion 128 of the plate 116 for pressing by the thumb of the user.

The lower portion 130 of the plate 116 is formed by a pair of axial legs 144. The pair of axial legs 144 of the lower portion 130 of the plate 116 extend, preferably collinearly, from the pair of axially legs 134 of the upper portion 128 of the plate 116, respectively, to define a bottom 146 of the lower portion 130 of the plate 116 that is open.

Each leg of the pair of axially legs 144 of the lower portion 130 of the plate 116 has an inner length 148 and the wall-engaging portion 126 of the pin 118 has a length 150. The wall-engaging portion 126 of the pin 118 is bent diagonally downwardly and rearwardly out of the lower portion 130 of the plate 116 with the length 150 of the wall-engaging portion 126 of the pin 118 being greater than the inner length 148 of each leg of the pair of axial legs 144 of the lower portion 130 of the plate 116 as a result of the bottom 146 of the lower portion 130 of the plate 116 being open.

The wall-engaging portion 126 of the pin 118 terminates in a free end 152 that is pointed for facilitating penetration into the wall 14.

C. Second Embodiment

Figure 5:
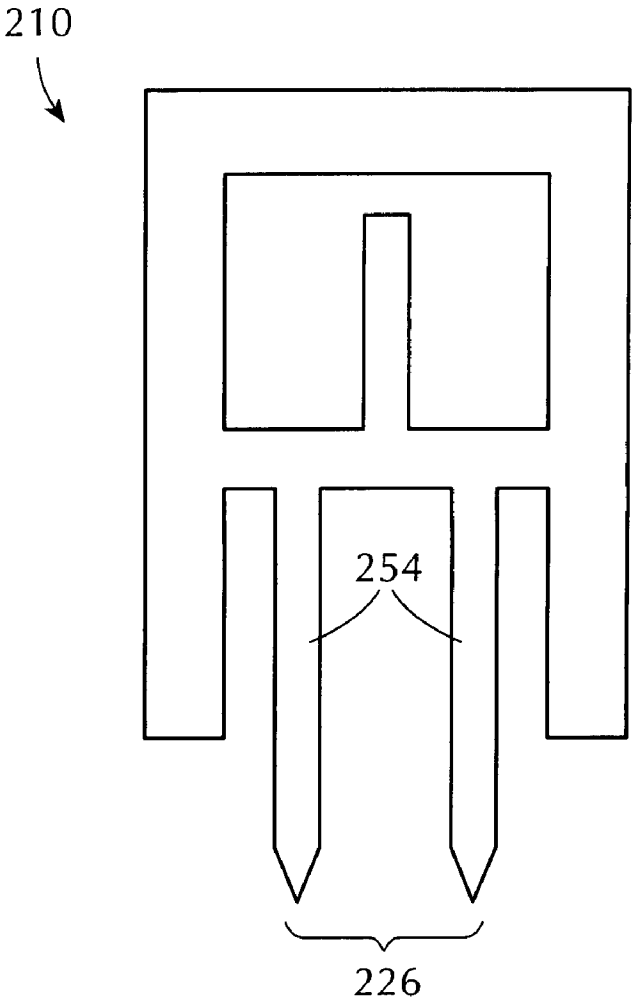
FIG. 5 is a diagrammatic front elevational view taken generally in the direction of ARROW 5 in FIG. 4.
Figure 4:
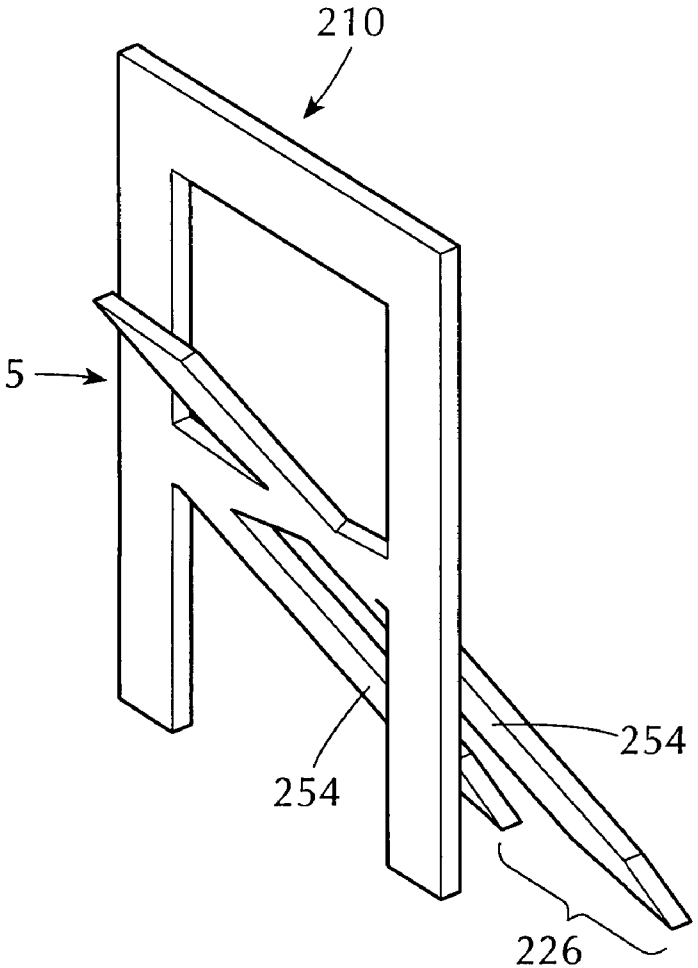
FIG. 4 is an enlarged diagrammatic perspective view of the area generally enclosed by the dotted curve identified by ARROW 4 in FIG. 1 of a second embodiment of the tack of the present invention.

The configuration of a second embodiment of the tack 210 can best be seen in FIGS. 4 and 5, which are respectively, an enlarged diagrammatic perspective view of the area generally enclosed by the dotted curve identified by ARROW 4 in FIG. 1 of a second embodiment of the tack of the present invention, and, a diagrammatic front elevational view taken generally in the direction of ARROW 5 in FIG. 4, and as such, will be discussed with reference thereto.

The tack 210 is similar to the tack 110, except that the wall-engaging portion 226 of the pin 218 is doubled to form a pair of wall-engaging portions 254 of the pin 218. The pair of wall-engaging portions 254 of the pin 218 straddle, and are parallel to, the picture-8 engaging portion 224 of the pin 218.

D. Third Embodiment

Figure 7:
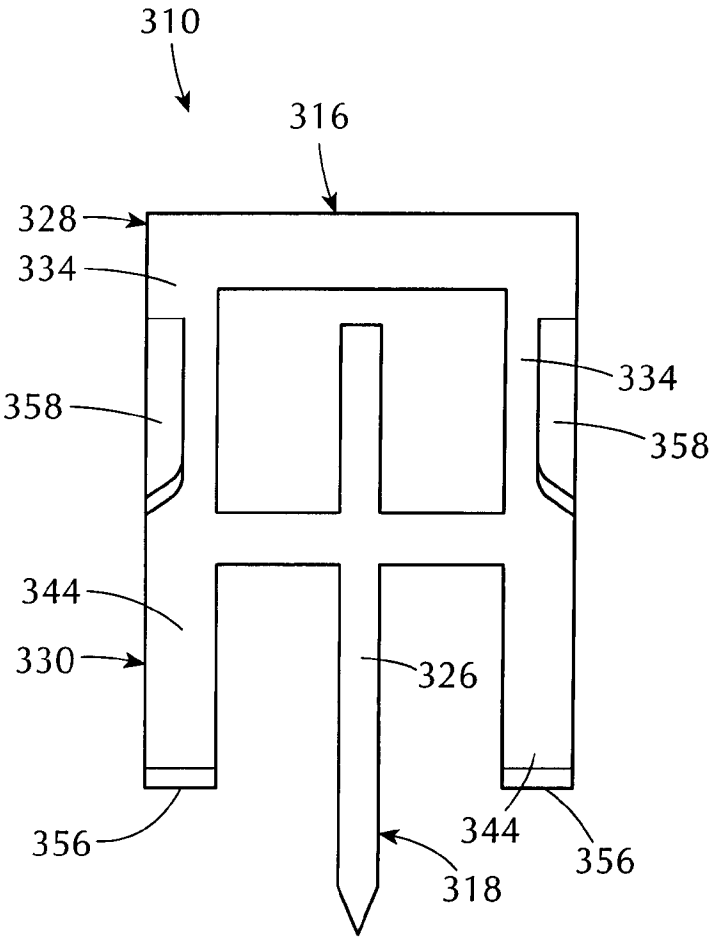
FIG. 7 is a diagrammatic front elevational view taken generally in the direction of ARROW 7 in FIG. 6.
Figure 6:
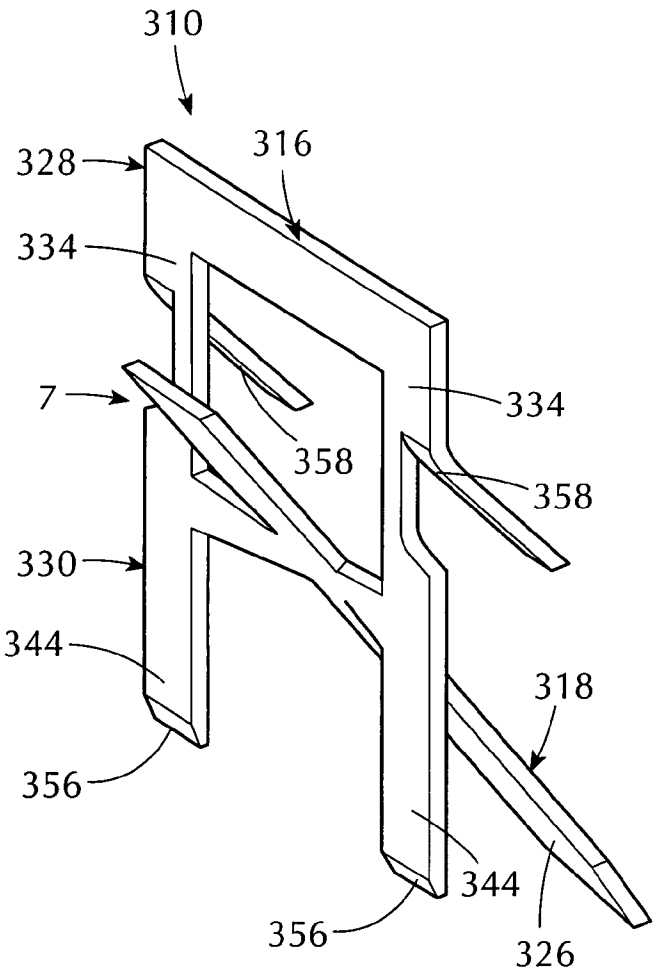
FIG. 6 is an enlarged diagrammatic perspective view of the area generally enclosed by the dotted curve identified by ARROW 6 in FIG. 1 of a third embodiment of the tack of the present invention.

The configuration of a third embodiment of the tack 310 can best be seen in FIGS. 6 and 7, which are respectively, an enlarged diagrammatic perspective view of the area generally enclosed by the dotted curve identified by ARROW 6 in FIG. 1 of a third embodiment of the tack of the present invention, and, a diagrammatic front elevational view taken generally in the direction of ARROW 7 in FIG. 6, and as such, will be discussed with reference thereto.

The tack 310 is similar to the tack 110, except that the pair of axial legs 344 of the lower portion 330 of the plate 316 terminate in free ends 356 that are beveled for safety, and, the pair of axial legs 334 of the upper portion 328 of the plate 316 have a pair of spikes 358, respectively, extending diagonally downwardly and rearwardly therefrom for penetrating the wall 14 when the plate 316 is pressed by the thumb of the user.

The pair of spikes 358 are one piece with the pair of axial legs 334 of the upper 22 portion 328 of the plate 316, respectively, and are stamped and bent therefrom.

The pair of spikes 358 are parallel to, spaced from, and straddle the wall-engaging portion 326 of the pin 318.

E. Conclusion

It will be understood that each of the elements described above, or two or more together, may also find a useful application in other types of constructions differing from the types described above.

While the invention has been illustrated and described as embodied in a tack for hanging an article from a wall, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A tack for hanging an article from a wall, comprising:

a) a plate; and b) a pin;

wherein said plate is for abutting the wall;

wherein said plate is for providing a surface for a thumb of a user to use to press said pin into the wall;

wherein said pin extends diagonally upwardly and forwardly from said plate for engaging the picture;

wherein said pin extends diagonally downwardly and rearwardly from said plate for penetrating the wall when said plate is pressed by the thumb of the user;

wherein said plate has a wall-facing surface;

wherein said plate has a picture-facing surface;

wherein said picture-facing surface of said plate is opposite to said wall-facing surface of said plate;

wherein said pin has a picture-engaging portion;

wherein said pin has a wall-engaging portion;

wherein said picture-engaging portion of said pin extends diagonally upwardly from said picture-facing surface of said plate;

wherein said wall-engaging portion of said pin extends diagonally downwardly from said wall-facing surface of said plate;

wherein said plate has an upper portion;

wherein said plate has a lower portion;

wherein said upper portion of said plate is divided from said lower portion of said plate by a cross member of said plate;

wherein said upper portion of said plate is inverted U-shaped;

wherein said upper portion of said plate is formed by a pair of axial legs;

wherein said upper portion of said plate is formed by an upper transverse portion;

wherein the inverted U-shaped upper portion of the plate is defined by said upper transverse portion and said pair of axial legs extending downwardly from the upper transverse portion;

wherein said pair of axial legs of said upper portion of said plate are connected to each other by said upper transverse portion of said upper portion of said plate and said pair of axial legs define a bottom of said upper portion of said plate:

wherein said bottom of said upper portion of said plate is closed by said cross member of said plate;

wherein said pair of axial legs of said upper portion of said plate have a pair of spikes, respectively; and wherein said pair of spikes of said pair of axial legs of said upper portion of said plate extend diagonally downwardly and rearwardly from said pair of axial legs respectively at said bottom of said upper portion of the plate.

2. The tack of claim 1, wherein said wall-engaging portion of said pin is singular; and wherein said wall-engaging portion of said pin is collinear with said picture-engaging portion of said pin.

3. The tack of claim 1, wherein said pin is one piece with said plate;

wherein said pin is stamped from said plate; and wherein said pin is bent from said plate.

4. The tack of claim 1, wherein said picture-engaging portion of said pin extends diagonally upwardly and forwardly from said cross member of said plate; and wherein said wall-engaging portion of said pin extends diagonally downwardly and rearwardly from said cross member of said plate.

5. The tack of claim 1, wherein each leg of said pair of axially legs of said upper portion of said plate has an inner length;

wherein said picture-engaging portion of said pin has a length; and wherein said length of said picture-engaging portion of said pin is less than said inner length of each leg of said pair of axial legs of said upper portion of said plate so as to allow said picture-engaging portion of said pin to be bent diagonally upwardly and forwardly out of said upper portion of said plate without interference from said upper transverse portion of said upper portion of said plate.

6. The tack of claim 1, wherein said upper transverse portion of said upper portion of said plate, together with said cross member of said plate, provide a rigid and continuous surface of said upper portion of said plate for pressing by the thumb of the user.

7. The tack of claim 1, wherein said lower portion of said plate is formed by a pair of axial legs;

wherein said pair of axial legs of said lower portion of said plate extend from said pair of axially legs of said upper portion of said plate, respectively, to define a bottom of said lower portion of said plate; and wherein said bottom of said lower portion of said plate is open.

8. The tack of claim 7, wherein said pair of axial legs of said lower portion of said plate extend collinearly from said pair of axially legs of said upper portion of said plate, respectively.

9. The tack of claim 7, wherein each leg of said pair of axially legs of said lower portion of said plate has an inner length;

wherein said wall-engaging portion of said pin has a length; and wherein said wall-engaging portion of said pin is bent diagonally downwardly and rearwardly out of said lower portion of said plate with said length of said wall-engaging portion of said pin being greater than said inner length of each leg of said pair of axial legs of said lower portion of said plate as a result of said bottom of said lower portion of said plate being open.

10. The tack of claim 1, wherein said wall-engaging portion of said pin terminates in a free end; and wherein said free end of said wall-engaging portion of said pin is pointed for facilitating penetration into the wall.

11. The tack of claim 1, wherein said wall-engaging portion of said pin is doubled to form a pair of wall-engaging portions.

12. The tack of claim 11, wherein said pair of wall-engaging portions of said pin straddle said picture-engaging portion of said pin.

13. The tack of claim 11, wherein said pair of wall-engaging portions of said pin are parallel to said picture-engaging portion of said pin.

14. The tack of claim 7, wherein said pair of axial legs of said lower portion of said plate terminate in free ends; and wherein said free ends of said pair of axial legs of said lower portion of said plate are beveled.

15. The tack of claim 1, wherein said pair of spikes are one piece with said pair of axial legs of said upper portion of said plate, respectively;

wherein said pair of spikes are stamped from said pair of axial legs of said upper portion of said plate, respectively; and wherein said pair of spikes are bent from said pair of axial legs of said upper portion of said plate, respectively.

16. The tack of claim 1, wherein said pair of spikes are parallel to said wall-engaging portion of said pin;

wherein said pair of spikes are spaced from said wall-engaging portion of said pin; and wherein said pair of spikes straddle said wall-engaging portion of said pin.

* * * * *